US009731942B2

(12) United States Patent
Archer et al.

(10) Patent No.: US 9,731,942 B2
(45) Date of Patent: Aug. 15, 2017

(54) SECURED GRIPPING SYSTEM

(71) Applicant: AREVA NP, Courbevoie (FR)

(72) Inventors: Joël Archer, Nantes (FR); Olivier Sevrin, Cosne sur Loire (FR)

(73) Assignee: AREVA NP, Courbevoie (FR)

( * ) Notice: Subject to any disclaimer, the term of this patent is extended or adjusted under 35 U.S.C. 154(b) by 0 days.

(21) Appl. No.: 14/891,751

(22) PCT Filed: May 16, 2014

(86) PCT No.: PCT/FR2014/051142

§ 371 (c)(1),
(2) Date: Nov. 17, 2015

(87) PCT Pub. No.: WO2014/184502

PCT Pub. Date: Nov. 20, 2014

(65) Prior Publication Data

US 2016/0090277 A1 Mar. 31, 2016

(30) Foreign Application Priority Data

May 17, 2013 (FR) ..... 13 54447

(51) Int. Cl.
*B66C 1/62* (2006.01)
*B66C 1/42* (2006.01)
*B66C 1/10* (2006.01)

(52) U.S. Cl.
CPC ..... *B66C 1/422* (2013.01); *B66C 1/10* (2013.01)

(58) Field of Classification Search
CPC ..... B66C 1/422; B66C 1/10
USPC .... 294/81.61, 110.1, 110.2, 67.31, 113, 118, 294/201
See application file for complete search history.

(56) References Cited

U.S. PATENT DOCUMENTS 1,506,827 A * 9/1924 Gellert ..... B66C 1/422 294/106
2,342,506 A * 2/1944 Rudolph ..... B66C 1/422 294/106
2,822,210 A * 2/1958 Gebhart ..... A01D 87/003 123/196 M
3,297,353 A * 1/1967 Carlson ..... B66C 1/48 294/106

(Continued)

FOREIGN PATENT DOCUMENTS

CN 87203329 U 3/1988
CN 2597442 Y 1/2004

(Continued)

OTHER PUBLICATIONS

Search Report for corresponding International Application PCT/FR2014/051142.

*Primary Examiner* — Paul T Chin
(74) *Attorney, Agent, or Firm* — Davidson, Davidson & Kappel, LLC

(57) ABSTRACT

A lifting beam is provided. The lifting beam includes a lower beam and an upper beam arranged above the lower beam; an arranger for arranging the beams in close and releasable engagement with one another; and systems for gripping the load. The gripping systems are kept in an open position when the beams are in engagement with one another, and in a closed position when an engager is released.

19 Claims, 4 Drawing Sheets

(56) References Cited

U.S. PATENT DOCUMENTS

| | | | | | |
|---|---|---|---|---|---|
| 3,306,646 | A * | 2/1967 | Flora, Jr. | B66C 1/427 | 294/106 |
| 3,348,872 | A * | 10/1967 | Kolinski | B66C 1/585 | 294/110.1 |
| 3,455,593 | A * | 7/1969 | Moro | B66C 1/422 | 294/110.1 |
| 3,508,780 | A * | 4/1970 | Bartman | B66C 1/422 | 294/110.1 |
| 3,561,615 | A * | 2/1971 | Forsberg | F16L 1/09 | 29/237 |
| 3,697,117 | A * | 10/1972 | Larson | B66C 1/422 | 294/106 |
| 3,942,834 | A * | 3/1976 | Kawaguchi | B66C 1/64 | 294/106 |
| 4,358,145 | A * | 11/1982 | Svensson | B66C 1/663 | 294/68.3 |
| 5,979,961 | A | 11/1999 | Carey | | |
| 6,123,376 | A | 9/2000 | Yakushinji | | |
| 6,322,120 | B1 | 11/2001 | Carey | | |
| 6,325,434 | B1 * | 12/2001 | Takao | B66C 1/422 | 294/118 |
| 7,455,338 | B2 * | 11/2008 | Jenney | B66C 1/10 | 294/67.5 |
| 8,109,550 | B1 * | 2/2012 | Benjamin | B66C 1/425 | 294/110.1 |

FOREIGN PATENT DOCUMENTS

| | | | |
|---|---|---|---|
| CN | 102923562 | A | 2/2013 |
| DE | 2054032 | A1 | 5/1972 |
| EP | 0857685 | A2 | 8/1998 |
| GB | 1224694 | A | 3/1971 |
| JP | S54129642 | A | 10/1979 |

* cited by examiner

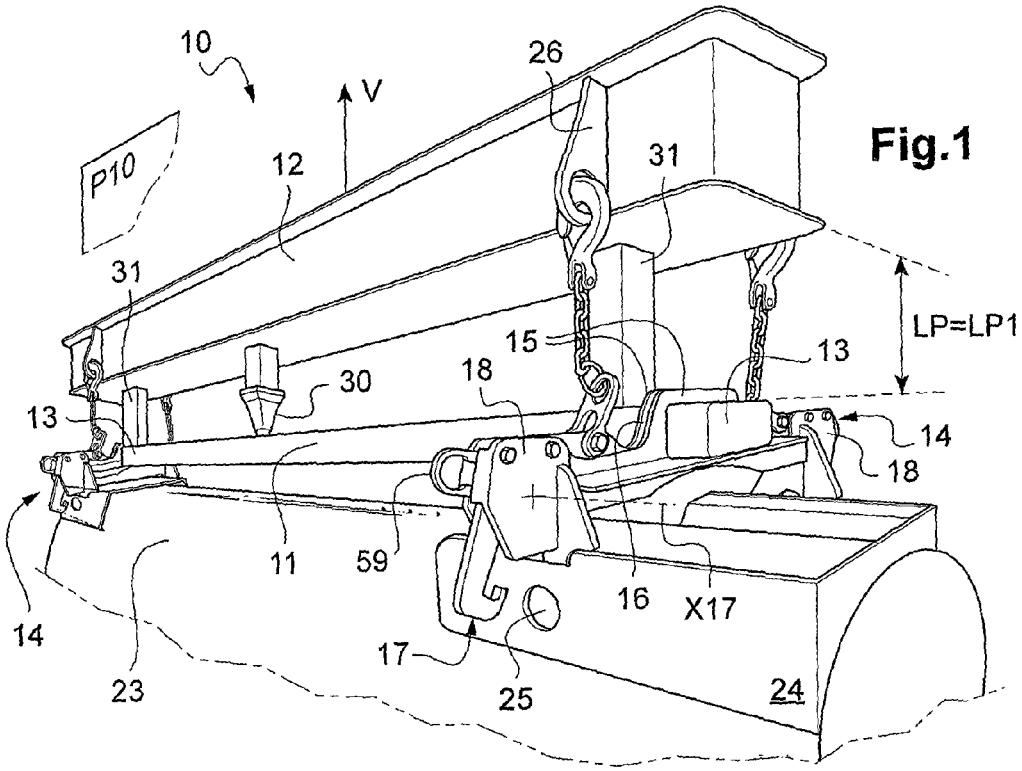
Fig.1
Fig.2
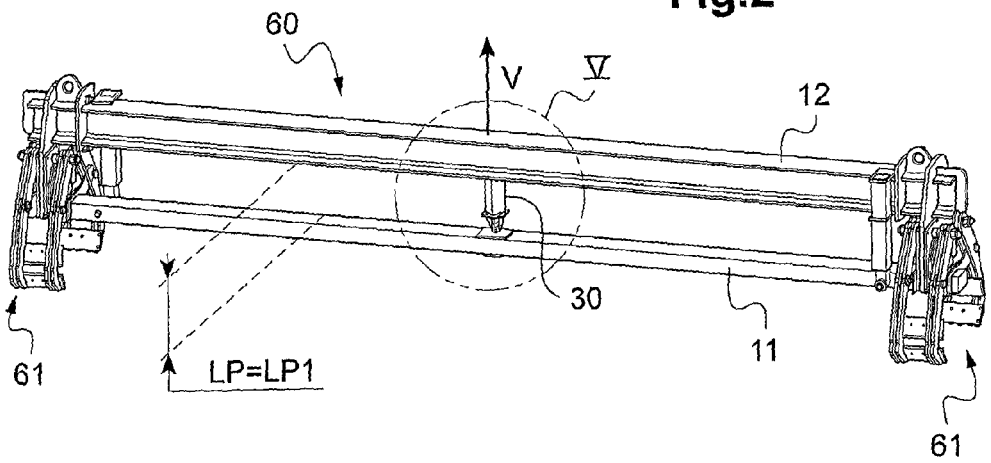

Fig.5
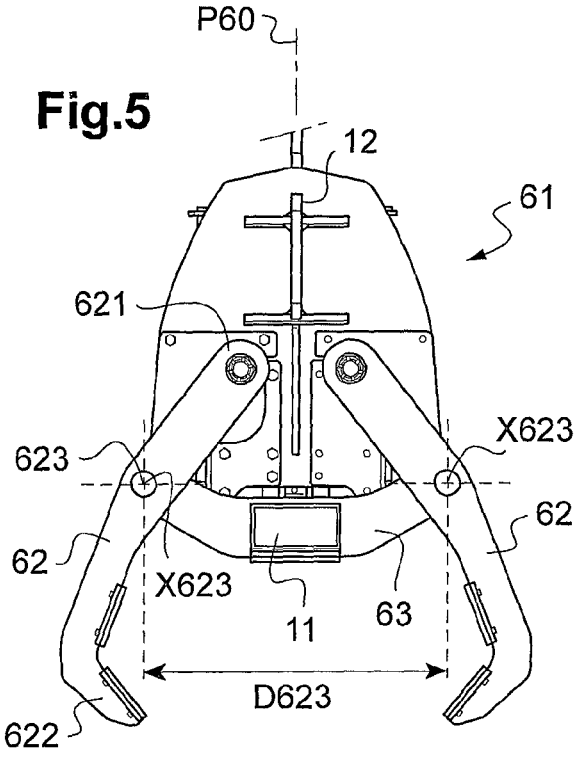
Fig.6
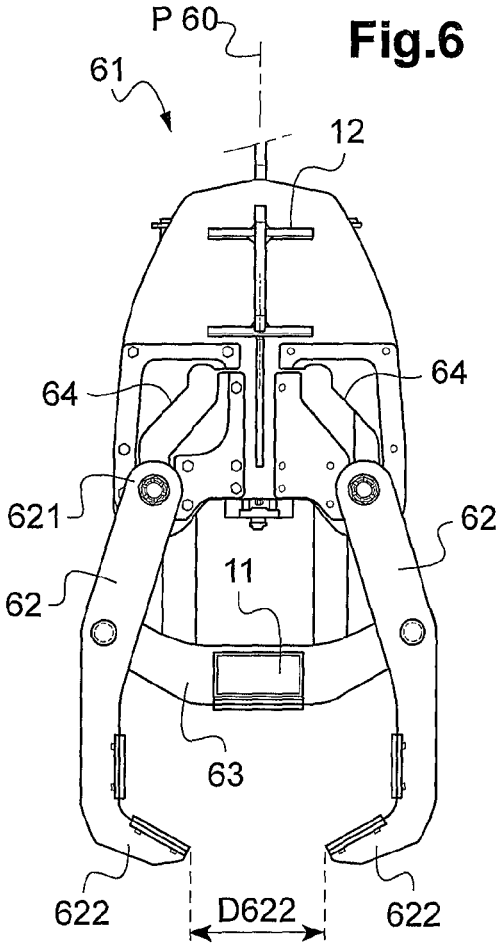
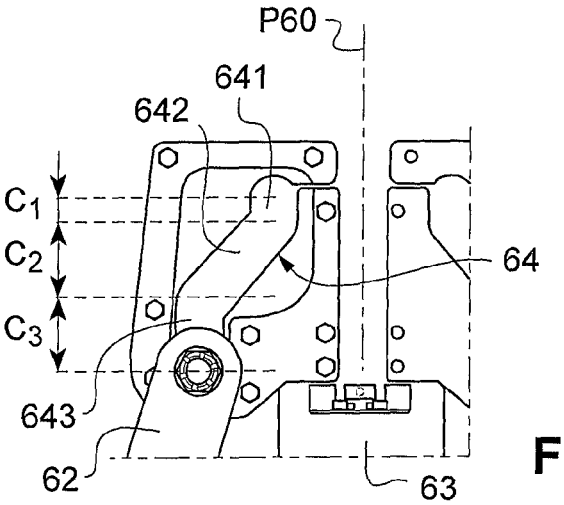
Fig.7

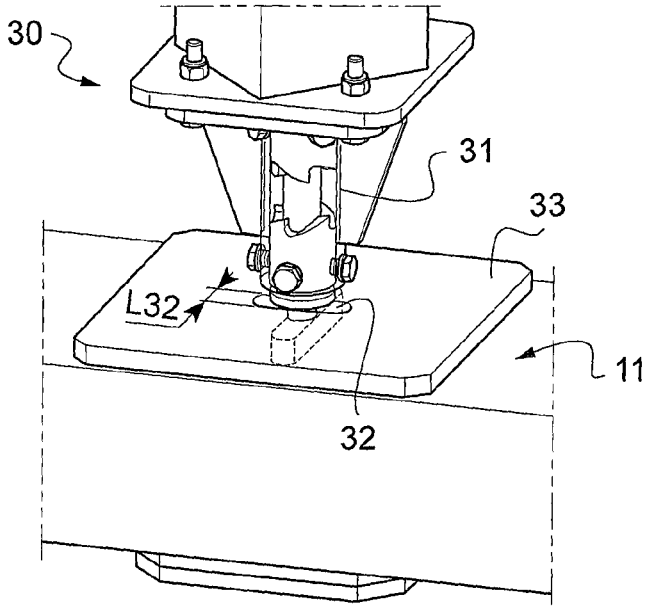
Fig.8
Fig.9
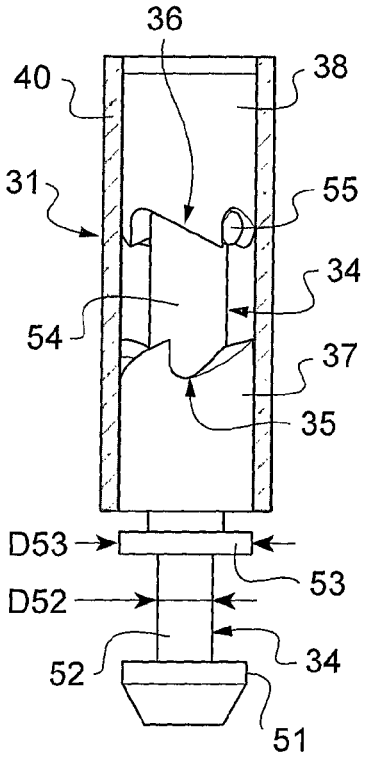
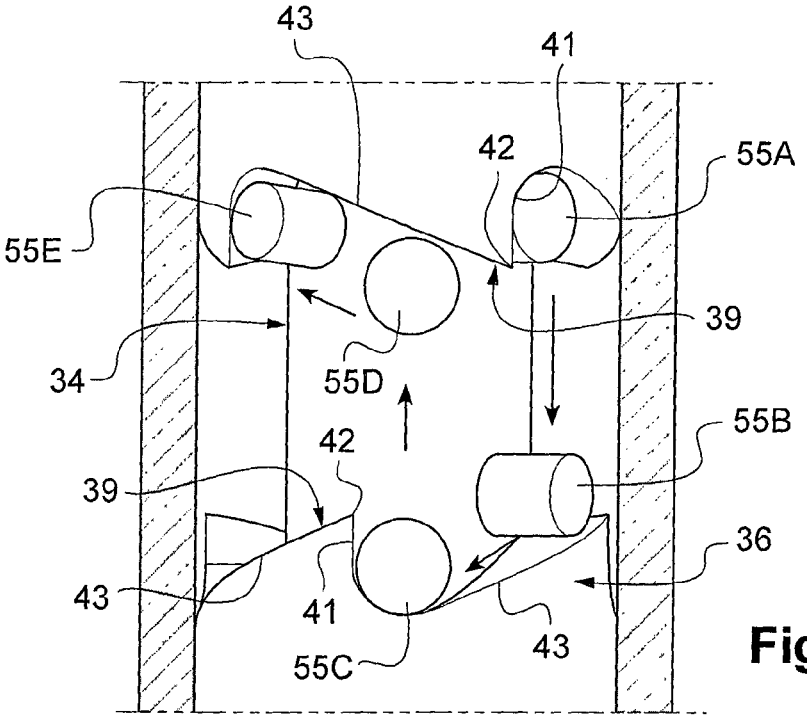
Fig.10

SECURED GRIPPING SYSTEM

The invention relates to the field of lifting devices, more particularly in gripping systems used in lifting beams.

BACKGROUND

Lifting beams are intended to carry cumbersome and heavy loads. They should ensure safety of the load and of the operators. However, present safety systems are generally active, i.e. they require the active participation of an operator and this safety system is therefore subject to a risk of human error.

SUMMARY OF THE INVENTION

An object of the invention is to provide a lifting beam device suitable for solving all or part of the problems mentioned above, notably for ensuring maximum passive safety.

A lifting beam device for lifting and/or displacing a load is provided that comprises:

- a lower beam positioned longitudinally;
- an upper beam positioned longitudinally above said lower beam;
- means for allowing vertical sliding of said beams one relative to the other;
- means for arranging the beams in close and releasable engagement with one another; and,
- at the longitudinal ends of said lifting beam device, one of the gripping systems for gripping said load, said gripping means

- being maintained in an open position when said beams are engaged with each other,
- assuming a closed position when the engagement means are released.

The means for arranging the beams in close and releasable engagement with one another advantageously comprise a quarter-turn device rigidly attached to one of the beams and comprising a gib formed with a free end, said gib being provided for engaging with an oblong window of the other beam.

In a first embodiment, each longitudinal end of the lower beam bears a transverse girder, a gripping system being jointed in rotation around a longitudinal axis, at each of the ends of said girder, each gripping system comprising:

- a proximal portion, forming a counterweight;
- a distal portion forming means for engaging the load, preferably hook-shaped; and,
- a sling attached through a first end to the counterweight and through a second end to the upper beam, the sling being dimensioned so as to be tensioned in the closed position and relaxed in the open position.

In a second embodiment, each of the longitudinal ends of the device comprises a gripping system, each of the systems comprising:

- a slide attached to one of the beams, preferably to the lower beam and slidably mounted vertically with respect to the other beam, preferably the upper beam;
- a guide forming a guiding rail for a first end of each fixed arm relatively to the other beam;
- two arms (62) symmetrically mounted with respect to each other relatively to a vertical longitudinal plane (P60),
- a first end of each arm being provided, guided by said rail;
- a preferably hook-shaped second end of each arm forming engagement means for the load;

- each arm being jointed in an intermediate point in rotation relatively to said slide, the rail comprising a guiding area designed so as to have the arms swing between an open position and a closed position, when the slide slides relatively to the other beam. Advantageously, the rail comprises another guiding area in which the arm is maintained in its closed position.

BRIEF SUMMARY OF THE DRAWINGS

Embodiments and alternatives will be described hereafter, as non-limiting examples, with reference to the appended drawings wherein:

FIG. 1 is a perspective view of a first embodiment for a lifting beam according to the invention, positioned in an open position on a tank to be displaced;

FIG. 2 is a perspective view of a second embodiment for a lifting beam according to the invention, illustrated alone;

FIG. 5 is a view of a gripping device, illustrated open, for the lifting beam of FIG. 2;

FIG. 6 is a view of a gripping device of FIG. 5, illustrated closed;

FIG. 7 is a detailed view of FIG. 6, illustrating a safety system;

FIG. 8 is a general view of a quarter-turn device for a lifting beam according to an embodiment of the invention, in a locked position;

FIG. 9 illustrates the quarter-turn device of FIG. 8, in isolation, in a partial sectional view; and, FIG. 10 is a detailed view of FIG. 9, illustrating the operation of the quarter-turn device.

DETAILED DESCRIPTION

Figure 3:
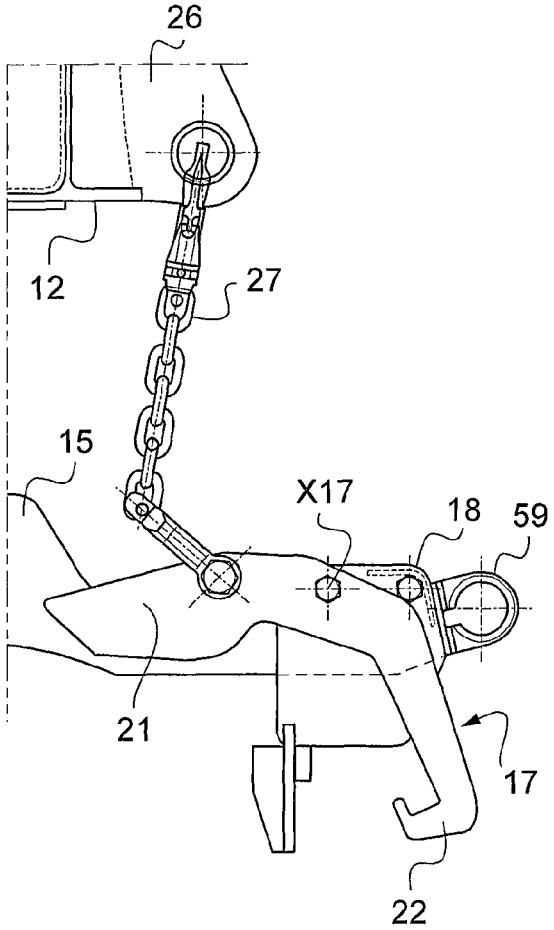
FIG. 3 is a view of a gripping device, illustrated open, for the lifting beam of FIG. 1.

FIG. 1 illustrates a first embodiment for a lifting beam 10 according to the invention.

The lifting beam 10 is substantially symmetrical with respect to a vertical longitudinal plane P10; it is also symmetrical with respect to a transverse vertical plane, perpendicular to the longitudinal plane of symmetry P10.

The lifting beam 10 comprises a lower beam 11 and an upper beam 12. The beams 11, 12 are box girders; they extend longitudinally substantially over the whole length of the lifting beam, one 12 above the other 11; they are substantially parallel with each other. Each end 13 of the lower beam 11 bears a transverse girder 14 comprising two plate-formed cheeks 15, longitudinally separated from each other by an interval 16. A gripping system 17 is jointed in rotation around a longitudinal axis X17, at each of the ends 18 of the girder 14.

The lifting beam 10 is handled by lifting means schematized in the figures by an arrow V; these lifting means may be a crane or a bridge crane, they are attached to the upper beam 12 by a hook and/or lifting slings.

Figure 4:
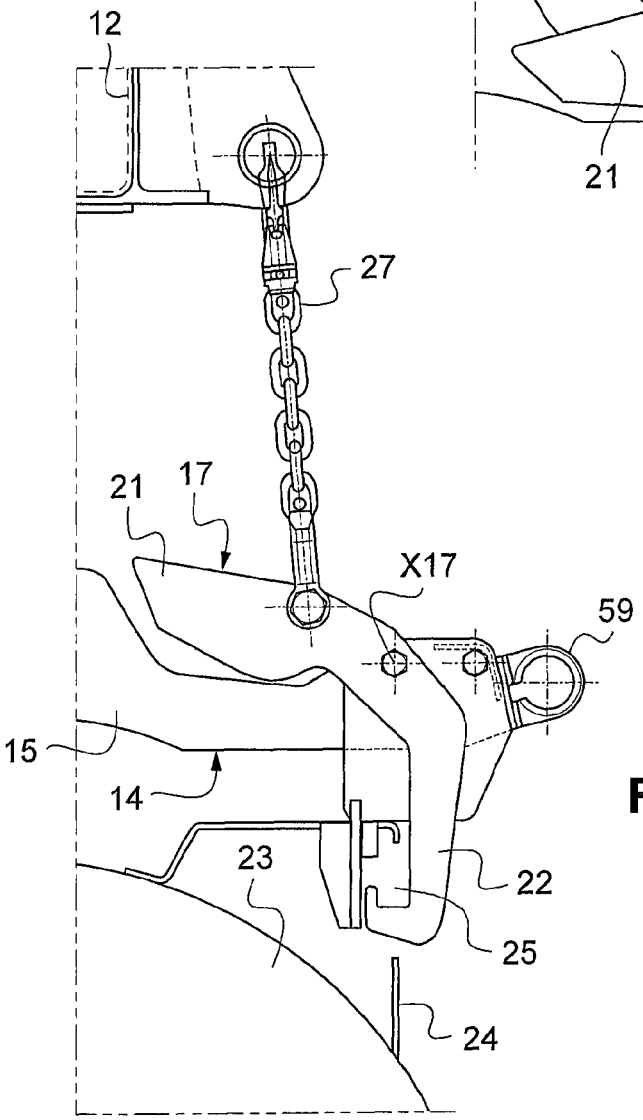
FIG. 4 is a view of a gripping device of FIG. 3, illustrated closed, engaged with the tank.

As particularly illustrated in FIGS. 3 and 4, the gripping system 17 comprises a proximal portion, relatively to the longitudinal plane of symmetry P1, forming a counterweight 21, and, a distal portion forming a hook 22. In the example of FIG. 1, the lifting beam 10 is used for lifting a tank 23. The tank 23 is equipped with vertical reinforcement plates 24 in which apertures 25 are made. Each hook 17 is provided for engaging with a respective aperture 25. The upper beam 12 comprises an eyelet 26 extending transversely substantially above each counterweight 21. A respective sling 27 is attached through a first end to the counterweight 21 and through a second end to the eyelet 26.

The lifting beam 10 further comprises means 30 for having the upper beam 12 and the lower beam 11 engaged with each other. It also comprises, in the vicinity of each of its ends, a guide 31, designed for ensuring vertical guiding of one of the beams 11, 12 relatively to other 12, 11.

As particularly illustrated in FIGS. 8 to 10, in the described examples, the engagement means 30 comprise a so-called <<quarter-turn>> device 31 extending downwards from the upper beam 12 and provided for engaging with an oblong window formed in an upper footing 33 of the lower beam 11.

The quarter-turn device 31 notably comprises a slide 34, lower teeth 35 and upper teeth 36. Each set of teeth 35, 36 is formed on the edge of a respective hollow cylinder 37, 38; the cylinders are positioned coaxially so that the teeth are opposite to each other. Each tooth 39 comprises, along a direction of rotation, identical for both teeth, a vertical front 41 and then a slope 43 surrounding a tip 42. The set of teeth are positioned so that the tip of a tooth 39 of one of them is facing the slope of a tooth of the other set of teeth. The cylinders bearing the sets of teeth are mounted set in a cylindrical sleeve 40 and form together with this sleeve a fixed portion, relatively to the upper beam 12, of the quarter-turn device.

The slide 34 is provided for axially sliding in the cylinders 37, 38 bearing the sets of teeth 35, 36. Its lower end is formed by a gib 51, of oblong shape, provided for cooperating with an oblong window 32 of the lower beam 11. Beyond the gib 51, from bottom to top, the slide comprises a cylindrical pin 52, a disc-shaped abutment 53, and then a cylindrical rod 54 slidably mounted in the cylinders bearing the sets of teeth. The slide further comprises a key 55 which extends radially from the rod 54. The slide thus forms a movable axis able to move upwards and downwards in the fixed portion 37, 38, 40.

The oblong shape of the gib 51 is such that:

- when it is positioned longitudinally, it may cross the window 32 of the lower beam and,
- when it is positioned transversely, as illustrated in FIG. 8, it cannot cross the window 32 of the lower beam.

The diameter D52 of the pin 52 is such that the pin may slide in the window 32 of the lower beam 11. The diameter D53 of the abutment 53 is greater than the width L32 of the window 32 of the lower beam 11, so that the slide 34 cannot penetrate into the beam beyond the pin 52.

FIG. 10 illustrates the operation of the quarter-turn device 30, by assuming that the device is in a so-called locked position illustrated in FIG. 8. In this locked position, the gib 51 is in a transverse position inside the lower beam 11; thus, the upper beam 12, which bears the quarter-turn device, is engaged with the lower beam 11. The distance LP between the beams is then a first value LP=LP1. The key 55 is in a position 55A, between two teeth of the upper set of teeth 36. As illustrated in FIGS. 1 and 3, the slings 27 are relaxed; the gripping system is in an open position; it remains there as long as the beams 11, 12 remain engaged with each other by means of the quarter-turn device.

When the lifting means V lift the upper beam 12, the fixed portion 37, 38, 40 moves upwards with the upper beam, until the key assumes a position 55B in contact with the lower set of teeth 35, at the top of the slope 43 which faces the position 55A. The pressure exerted by the key 55 on the lower set of teeth, while the upper beam continues its movement upwards, causes displacement of the key, until it assumes a position 55C, in abutment against a front 41 of the next tooth, at the same time forcing the slide 34 to rotate by an eighth of a turn in the fixed portion.

The lifting means V then causing the upper beam 12 to then move down again, the fixed portion 37, 38, 40 moves downwards with the upper beam while the disc 53 will bear against the lower beam, until the key assumes a position 55D in contact with the upper set of teeth 36, at the bottom of the slope 43 which is facing the position 55C. The pressure exerted by the key 55 on the upper set of teeth, while the upper beam continues its movement downwards, causes displacement of the key, until it assumes a position 55E, in abutment against a front 41 of the next tooth, at the same time forcing the slide 34 to rotate by an additional eighth of a turn in the fixed portion.

Thus, by successively moving upwards and downwards the upper beam it is possible to cause the slide 34 to perform a quarter of a turn, so that the gib is found in a longitudinal position; by raising again the upper beam it is possible to release the gib of the lower beam. The lifting beam 10 may then assume an unlocked position, illustrated in FIG. 4, in which the slings 27 are tensioned, driving the counterweights 21 upwards and engaging the hooks 22 into the apertures 25 provided for this purpose in the load 23. The distance LD between the beams 11, 12 then assumes a second value LD=LD2, greater than the first distance LD1; the gripping system is in a closed position.

When the load is deposited, it is sufficient to cause once again successive upward and downward movements of the upper beam 12 so as to first have the gib penetrate into the window 32 and to have it accomplish again a quarter of a turn. The slings are then relaxed, the hooks 22 swing outwards under the action of their respective counterweights 21; the hooks are open and release their engagement with the load. The lifting beam may then be removed leaving the load where it has been deposited.

It is noted that each end of the transverse girders 14 comprises a ring 59 for hooking up thereon a rope or a pole, in order to ensure the horizontal positioning of the lifting beam.

The method therefore consists in the following steps:

- The lifting beam is first of all brought above the equipment to be handled, here the load which is a tank, for example via a bridge crane and positioned above the load by an operator, for example by means of a pole; and then,
- the lifting beam assembly then bears upon the equipment to be handled so as to be released from the quarter-turn system so as to be in an open position which allows, during lifting, tensioning of the slings and consequently obtaining the closing of the gripping system; and then,
- the assembly is then lifted and displaced as far as the area provided for depositing thereon the load; and then,
- during the deposition of the load, the lifting beam assembly returns for being supported on the latter so as to again be locked in the quarter-turn system and therefore to return to the <<high>> position. It is this return to the high position which has the consequence of relaxing the slings and therefore opening the gripping system, which allows extraction of the lifting beam.

A second embodiment of a lifting beam according to the invention will now be described with reference to FIGS. 2 and 5 to 7, in that it differs from the first embodiment described earlier.

FIG. 2 illustrates a lifting beam 60 which differs from the first embodiment essentially because these gripping systems 61 are cam systems and not with slings. The gripping systems and their operation are illustrated in detail in FIGS. 5 to 6. FIG. 5 illustrates one of the gripping systems 61 in an open position; FIG. 6 illustrates the same system in a closed position.

In this embodiment, the gripping system notably comprises two arms 62 and a slide 63 and a guide 64. Both arms 62 are positioned symmetrically to each other relatively to the longitudinal plane of symmetry P60 of the lifting beam 60. This plane P60 is the equivalent of the plane P10 of the lifting beam 10 of the first embodiment.

The guide 64 is rigidly attached to the upper beam 12; it comprises two rails 64 symmetrical to each other relatively to the longitudinal plane P60 of symmetry of the lifting beam 60. As particularly illustrated in FIG. 7, each rail 64 comprises, from top to bottom, a first area 641, substantially vertical, a second area 642 gradually moving away from the plane of symmetry P60, and a third area 643, substantially vertical.

The slide 60 is designed so as to vertically slide relatively to the upper beam 12. In the lower portion, the slide is rigidly attached to the lower beam 11, so that it slides downwards relatively to the upper beam when the lower beam 11 moves away from the upper beam 12, and, slides upwards relatively to the upper beam when the lower beam 11 moves closer to it.

Each arm 62 comprises a first end 621 provided for covering while being guided thereon, a respective rail 64. In the illustrated example, the rail has the shape of a window and the end comprises a roller mounted so as to roll along the edges of this window. A second end 622 of the arm 62 comprises a hook shape, adapted so as to engage with a load to be lifted and moved. An intermediate point 623 of the arm is jointed with the slide 63, around a horizontal axis X623. The slide imposes a fixed distance D623 between this intermediate point and the intermediate point 623 of the other arm 62.

In the open position, illustrated in FIG. 5, the first end 621 is in the first area 641 of the rail 64, so that this first end is close to the first end 641 of the other arm 62. When the slide 63 slides downwards relatively to the upper beam 12, the first end 621 of the arms first covers the first area 641 which corresponds to a first vertical travel C1. They then cover the second area 642, covering a second vertical aperture travel C2. During the covering of the second area, both first ends gradually move away from each other; this moving away causes rotation of the arms around their respective intermediate point 623, and therefore the second ends 622 move closer to each other. Thus, when they attain the third area 643, the second ends are moved away from each other, the hooks are at a reduced distance D622 from each other, and the gripping device is in the closed position illustrated in FIG. 6.

When the first ends 621 cover the third area 643, the distance D622 between the hook 622 remains constant, all along a third vertical travel C3. Thus, when the gripping device is in its closed position, the third travel C3 forms a safety travel; i.e. if the load or the lifting beam are subject to an impact which would tend to bring both beams 11, 12, closer together, the gripping device remains in a closed position as long as the first ends remain in the third area 643.

Thus, this avoids immediate opening of the gripping system 61 during an impact, the opening and the closing of the latter being accomplished via a guide 63 which gives the possibility of obtaining a safety travel C3 which, even in the case of an impact, prevents the opening of the gripping system.

Further, the advantage of this guiding system with a cam is also the fact that it provides firm attachment of the elements of the gripping system as well as a significant reduction in the frictional stresses which consequently are negligible. This has the consequence of complete and secured alternation of the gripping system.

Of course, the invention is not limited to the examples which have just been described.

Thus, in a closed position, provision may be made so that the hooks are further away from each other than in the open position, the hooks being provided turned oppositely to each other.

What is claimed is:

1. A lifting beam device for lifting and/or displacing a load comprising:

a lower beam positioned longitudinally;

an upper beam positioned longitudinally above the lower beam;

a guide configured for allowing vertical sliding of the beams one relative to the other;

an engager configured for arranging the beams in close and releasable engagement with one another; and grippers at the longitudinal ends of the lifting beam device configured for gripping the load, the grippers configured for being maintained in an open position when the upper beam and the lower beam are engaged with each other, the grippers configured for assuming a closed position when the engagement device is released, each of the longitudinal ends of the lifting beam device including one of the grippers, each of grippers comprising:

a slide attached to one of the upper beam or the lower beam and slidably mounted vertically relatively to the other of the upper beam and the lower beam;

one of the guides forming a guiding rail fixed relatively to the other of the upper beam and the lower beam; and two arms symmetrically mounted relatively to each other, relatively to a vertical longitudinal plane, a first end of each arm being guided by the rail, a second end of each arm being adapted for engaging with the load, each arm being jointed in an intermediate point in rotation relatively to the slide, the rail comprises a guiding area designed for having the arms swing between an open position and a closed position, when the slide slides relatively to the other of the upper beam and the lower beam.

2. The device as recited in claim 1 wherein the engager includes a quarter-turn device rigidly attached to one of the upper beam and the lower beam, the quarter-turn device including a gib formed at a free end, the gib being provided for engaging with an oblong window of the other beam.

3. The device as recited in claim 1 wherein the slide is attached to the lower beam.

4. The device as recited in claim 1 wherein the second end of each arm is hook-shaped.

5. The device as recited in claim 1 wherein the rail comprises another guiding area in which the arms are maintained in the closed position.

6. A lifting beam device for lifting and/or displacing a load comprising:

a lower beam positioned longitudinally;

an upper beam positioned longitudinally above the lower beam;

a guide configured for allowing vertical sliding of the beams one relative to the other;

an engager configured for arranging the beams in close and releasable engagement with one another; and grippers at the longitudinal ends of the lifting beam device configured for gripping the load, the grippers configured for being maintained in an open position when the upper beam and the lower beam are engaged with each other, the grippers configured for assuming a closed position when the engagement device is released, wherein each longitudinal end of the lower beam bears a transverse girder and one of the grippers jointed in rotation around a longitudinal axis, at each end of the respective girder, each of the grippers comprising:

a proximal portion, forming a counterweight;

a distal portion adapted for engaging with the load; and a sling attached through a first end to the counterweight and through a second end to the upper beam, the sling being dimensioned so as to be tensioned in the closed position and relaxed in the open position.

7. The device as recited in claim 6 wherein the distal portion is hook-shaped.

8. A lifting beam device for lifting and/or displacing a load comprising:

a lower beam positioned longitudinally;

an upper beam positioned longitudinally above the lower beam, the lower beam and the upper beam being vertically movable one relative to the other;

a guide configured for allowing vertical sliding of the beams one relative to the other;

a releasable engager configured for holding the lower beam and the upper beam close to one another, the engager releasable to allow one of the lower beam and the upper beam to move away from the other; and grippers for gripping the load, the grippers being arrangeable in an open position for releasing the load and a closed position for gripping the load, the grippers being in the open position when the upper beam and the lower beam are held close to one another by the engager and in the closed position when the engager is released, each of the grippers comprising two arms, each of the arms having:

a first end guided by a rail provided on one of the lower beam and the upper beam;

an intermediate point mounted pivotally on the other one of the lower beam and the upper beam, the rail comprising a guiding area designed for causing the arm to pivot between the open position and the closed position when the lower beam and the upper beam move one relative to the other; and a second end for engaging with the load.

9. The device as recited in claim 8 wherein the engager includes a quarter-turn device rigidly attached to one of the upper beam and the lower beam, the quarter-turn device including a gib formed at a free end, the gib being provided for engaging with an oblong window of the other beam.

10. The device as recited in claim 8 wherein the second end of each arm is hook-shaped.

11. The device as recited in claim 8 wherein the rail comprises another guiding area in which the arms are maintained in the closed position.

12. The device as recited in claim 11 wherein the arms of each gripper remain in the closed position as long as the first ends of the arms are in the other guiding area in which the arms are maintained in the closed position.

13. The device as recited in claim 11 wherein the other guiding area in which the arms are maintained in the closed position extends all along a vertical travel.

14. The device as recited in claim 13 wherein the vertical travel forms a safety travel preventing opening of the gripper if the load or the lifting beam are subject to an impact which would tend to bring the upper beam and the lower beams closer together.

15. The device according to claim 11 wherein each rail comprises from top to bottom a guiding area substantially vertical, the guiding area designed for causing the arm to pivot between the open position and the closed position, and the other guiding area in which the arms are maintained in the closed position.

16. The device according to claim 8 wherein the distance between the intermediate points of the two arms is fixed.

17. The device according to claim 8 wherein the first ends of the two arms of each gripper are guided in a respective rail.

18. The device according to claim 8, wherein the two arms of each gripper are mounted symmetrically relatively to each other, relatively to a vertical longitudinal plane.

19. The device according to claim 18, wherein the guiding area designed for causing the arm to pivot between the open position and the closed position of each rail gradually moves away from the vertical longitudinal plane such that the first ends of the arms sliding in the guiding area designed for causing the arm to pivot between the open position and the closed position gradually move away from each other and the second ends of the arms gradually move closer to each other.

* * * * *